US010488801B2

(12) United States Patent
Kagawa

(10) Patent No.: US 10,488,801 B2
(45) Date of Patent: Nov. 26, 2019

(54) IMAGE FORMING APPARATUS

(71) Applicant: CANON KABUSHIKI KAISHA, Tokyo (JP)

(72) Inventor: Yosuke Kagawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/032,498

(22) Filed: Jul. 11, 2018

(65) Prior Publication Data

US 2019/0025742 A1 Jan. 24, 2019

(30) Foreign Application Priority Data

Jul. 20, 2017 (JP) ..... 2017-141251

(51) Int. Cl.
*G03G 15/00* (2006.01)
*G03G 15/16* (2006.01)

(52) U.S. Cl.
CPC ..... *G03G 15/5037* (2013.01); *G03G 15/1675* (2013.01); *G03G 15/5054* (2013.01); *G03G 15/55* (2013.01); *G03G 15/80* (2013.01); *G03G 15/1615* (2013.01); *G03G 2215/00632* (2013.01)

(58) Field of Classification Search
CPC ..... G03G 15/1675; G03G 15/5054; G03G 15/5037
See application file for complete search history.

(56) References Cited

U.S. PATENT DOCUMENTS 7,266,318 B2 * 9/2007 Inukai ..... G03G 15/1675 399/66
9,829,837 B2 * 11/2017 Ishikawa ..... G03G 15/1665
2016/0202641 A1 * 7/2016 Kojima ..... G03G 15/1605 399/66

FOREIGN PATENT DOCUMENTS

JP 10-307490 A 11/1998
JP 3847875 B2 11/2006
JP 2013-008048 A 1/2013

* cited by examiner

*Primary Examiner* — Walter L Lindsay, Jr.
*Assistant Examiner* — Arlene Heredia
(74) *Attorney, Agent, or Firm* — Venable LLP

(57) ABSTRACT

An image forming apparatus includes a controller configured to execute a mode for correcting a transfer voltage during a continuous image forming job of forming an image on a plurality of recording materials. The controller is configured to correct the transfer voltage on the basis of detection results which are detected by a voltage detection unit and a current detection unit during a predetermined time.

10 Claims, 10 Drawing Sheets

(PRIOR ART)

(PRIOR ART)

IMAGE FORMING APPARATUS

BACKGROUND OF THE INVENTION

Field of the Invention

The present invention relates to image forming apparatuses that utilize electrophotography techniques, such as printers, copying machines, facsimile machines, and multifunction machines.

Description of the Related Art

An intermediate transfer-type image forming apparatus is known as an example of an image forming apparatus, where toner image formed on a photosensitive drum is primarily transferred to an intermediate transfer belt, and the toner image primarily transferred to the intermediate transfer belt is secondarily transferred to a recording material. Further, a direct transfer-type image forming apparatus is known, where toner image formed on a photosensitive drum is directly transferred to a recording material. The toner image formed on the intermediate transfer belt or the photosensitive drum is transferred to a recording material at a transfer nip portion that is formed by abutting a transfer roller having conductivity against the intermediate transfer belt or the photosensitive drum. Transfer voltage is applied from a high voltage power supply to the transfer roller in order to transfer the toner image to the recording material.

Electric resistance of the transfer roller is varied by fluctuation of environment, such as temperature and humidity, or deterioration caused by long-term use. During an image forming job in which images are formed continuously to a large number of recording materials, if transfer voltage is not changed even though the electric resistance of the transfer roller has changed, target current that is suitable for transfer may not flow to the transfer nip portion, and transfer defects may be caused. Therefore, as disclosed in Publication of Japanese Patent No. 3847875, an apparatus is proposed that executes ATVC (Active Transfer Voltage Control) at interval between sheets, that is, between one recording material and a subsequent recording material that pass the transfer nip portion, each time image formation is performed to a predetermined number of recording materials during an image forming job. According to the ATVC at interval between sheets, reference voltage is corrected based on a current detected in correspondence with an application of a reference voltage configured to supply a target current to a transfer nip portion when there are no recording materials in the nip portion and voltage-current characteristics of a transfer roller obtained during pre-rotation of an image forming job and the like acquired in advance. Then, a sum of the corrected reference voltage and a predetermined voltage determined in advance in correspondence with the type of recording material and the like, which is referred to as a sheet borne voltage and the like, is set as the new transfer voltage.

Recently, in order to further enhance productivity of the image forming apparatus, there are demands to further improve processing speed during image forming and shorten the interval between recording materials being conveyed continuously, which is referred to as interval between sheets for convenience. If interval between sheets is shortened, while switching the voltage applied to the transfer roller during ATVC at interval between sheets from transfer voltage to reference voltage, there may be cases where current is detected during transition of voltage before the voltage actually applied to the transfer roller, referred to as actual voltage, reaches a reference voltage, or when sufficient sampling of current values cannot be acquired during the short interval between sheets.

SUMMARY OF THE INVENTION

According to a first aspect of the present invention, an image forming apparatus includes a rotatable image bearing member configured to bear a toner image, a transfer member configured to form a transfer nip portion by abutting against the image bearing member, and configured to transfer the toner image on the image bearing member to a recording material by being applied a transfer voltage, a power supply configured to apply a voltage to the transfer member, a voltage detection unit configured to detect the voltage applied to the transfer member from the power supply, a current detection unit configured to detect a current supplied to the transfer member, and a controller configured to execute a mode for correcting a command value of the transfer voltage during a continuous image forming job of forming an image to a plurality of recording materials. The controller is configured to, in the mode, (i) switch the command value of the voltage applied to the transfer member from a first value corresponding to the transfer voltage applied in a first transfer period for a first recording material to a reference value after the first transfer period before a second transfer period for a second recording material which is following the first recording material, and (ii) switch the command value from the reference value to a second value corresponding to the transfer voltage applied in the second transfer period, in case that a predetermined time has elapsed from switching the command value from the first value to the reference value, and (iii) correct the command value of the transfer voltage on the basis of detection results which are detected by the voltage detection unit and the current detection unit during the predetermined time.

According to a second aspect of the present invention, an image forming apparatus includes a rotatable image bearing member configured to bear a toner image, a transfer member configured to form a transfer nip portion by abutting against the image bearing member, and transfer the toner image on the image bearing member to a recording material by being applied a transfer voltage, a power supply configured to apply the transfer voltage to the transfer member, a voltage detection circuit configured to detect a voltage applied to the transfer member from the power supply, a current detection circuit configured to detect a current supplied to the transfer member, a converter configured to convert analog signals from the voltage detection circuit and the current detection circuit at a first conversion rate to digital signals, and a controller whose conversion rate for converting an analog signal to a digital signal is slower than the first conversion rate. The controller is configured to execute a mode for correcting a command value of the transfer voltage during a continuous image forming job of forming an image to a plurality of recording materials, the controller correcting the command value of the transfer voltage based on digital values which are converted by the converter after a first transfer period for a first recording material before a second transfer period for a second recording material which is following the first recording material.

Further features of the present invention will become apparent from the following description of exemplary embodiments with reference to the attached drawings.

DESCRIPTION OF THE EMBODIMENTS

Image Forming Apparatus

Figure 1:
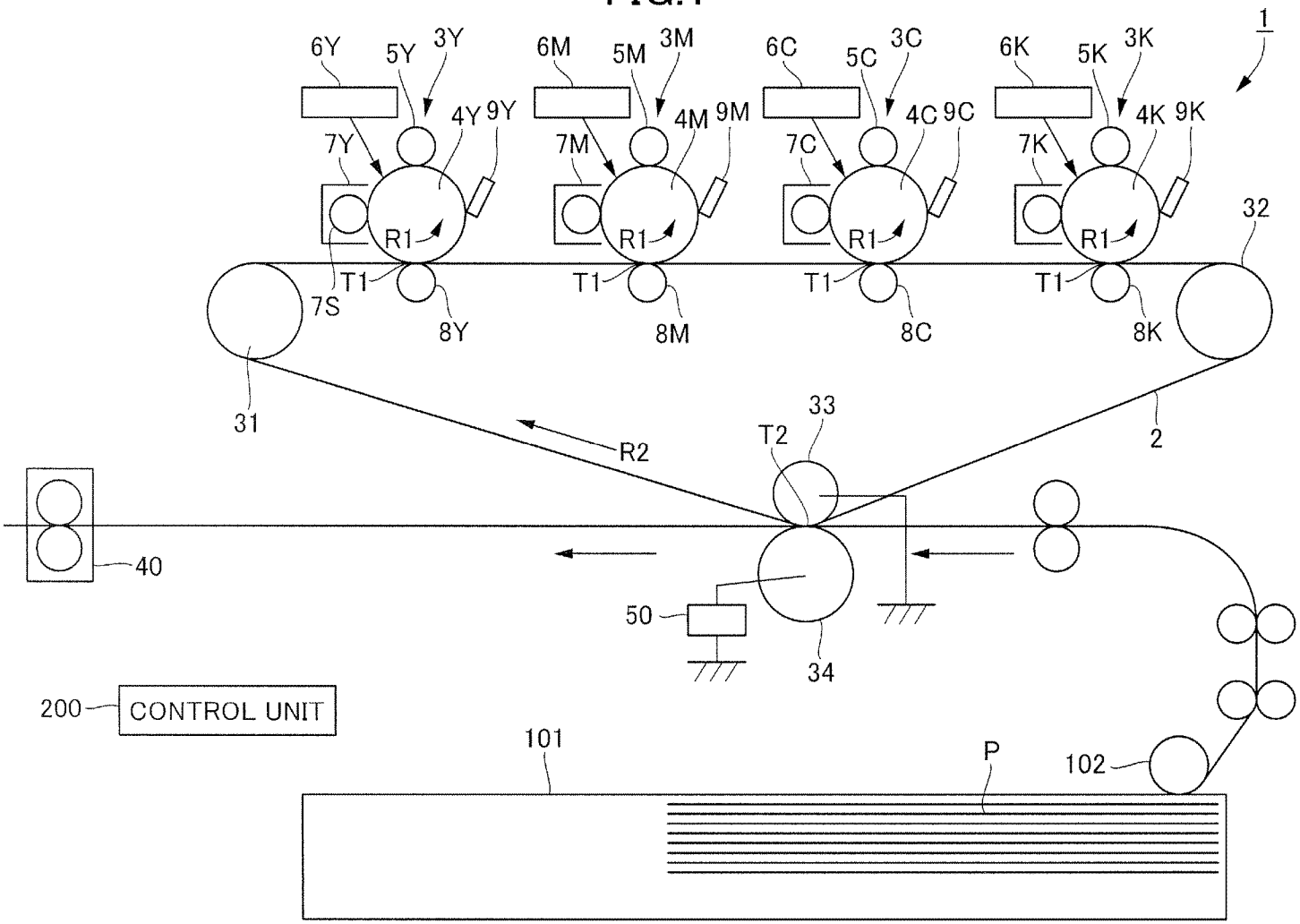
FIG. 1 is a schematic drawing illustrating a configuration of an image forming apparatus according to a present embodiment.

An image forming apparatus according to the present embodiment will be described. At first, a configuration of an image forming apparatus according to the present embodiment will be described with reference to FIG. 1. An image forming apparatus 1 illustrated in FIG. 1 is a tandem intermediate transfer-type full-color printer in which image forming units 3Y, 3M, 3C and 3K of yellow, magenta, cyan and black are arranged along an intermediate transfer belt 2. Of course, the image forming apparatus 1 is not restricted thereto, and it can be a monochrome color printer in which only a black image forming unit 3K is provided.

In the image forming unit 3Y, a yellow toner image is formed on a photosensitive drum 4Y and primarily transferred to the intermediate transfer belt 2. In the image forming unit 3M, a magenta toner image is formed on the photosensitive drum 4M and transferred to be superposed on the yellow toner image on the intermediate transfer belt. In image forming units 3C and 3K, cyan toner image and black toner image are respectively formed on the photosensitive drums 4C and 4K, which are sequentially transferred onto the intermediate transfer belt 2 in a superposed manner.

The image forming units 3Y, 3M, 3C and 3K are configured similarly, except that the colors of toners used in developing units 7Y, 7M, 7C and 7K are different, which are yellow, magenta, cyan and black. Therefore, in the following description, the image forming unit 3Y will be described in detail, and as for image forming units 3M, 3C and 3K, the letter Y on the end of the reference numbers should be read as M, C or K.

In the image forming unit 3Y, a charge roller 5Y, an exposing unit 6Y, a developing unit 7Y, a primary transfer roller 8Y and a drum cleaner 9Y are arranged in a manner surrounding the photosensitive drum 4Y. The photosensitive drum 4Y is a drum-shaped electrophotographic photosensitive member in which a photosensitive layer is formed on an outer circumference surface of an aluminum cylinder and that is rotated in a direction of arrow R1 at a predetermined processing speed by a motor (not shown).

The charge roller 5Y charges the surface of the photosensitive drum 4Y uniformly to negative dark potential applying a charge voltage in which AC voltage is superposed to negative DC voltage. The exposing unit 6Y scans laser beams in which image data scanning lines having expanded a separated color image of the respective color images is subjected to ON-OFF modulation using a rotation mirror and writes an electrostatic latent image of the image on the surface of the photosensitive drum 4Y that has been charged.

The developing unit 7Y supplies toner to the photosensitive drum 4Y and develops the electrostatic latent image to a toner image. In the developing unit 7Y, a developing sleeve 7S arranged with a slight gap from the surface of the photosensitive drum 4Y is rotated in a counter direction with respect to the photosensitive drum 4Y at a predetermined processing speed. The developing unit 7Y stores a two-component developer including nonmagnetic toner having negative charging characteristics and magnetic carrier having positive charging characteristics, wherein the two-component developer is borne on the developing sleeve 7S and conveyed to a portion opposed to the photosensitive drum 4Y. In a state where developing voltage in which AC voltage is superposed to DC voltage is applied to the developing sleeve 7S, toner charged to negative polarity is transferred to an exposed portion of the photosensitive drum 4Y being relatively positively charged, and the electrostatic latent image is reverse developed. In FIG. 1, the developing sleeve 7S is illustrated only in the developing unit 7Y, but of course, the developing sleeve 7S is also included in developing units 7M, 7C and 7K.

The primary transfer roller 8Y presses the intermediate transfer belt 2 and forms a primary transfer portion T1 between the photosensitive drum 4Y and the intermediate transfer belt 2. A primary transfer power supply (not shown) is connected to the primary transfer roller 8Y, and in a state where the primary transfer power supply applies primary transfer voltage having positive polarity to the primary transfer roller 8Y, the toner image charged to negative polarity and formed on the photosensitive drum 4Y, serving as the photosensitive member, is transferred to the intermediate transfer belt 2. In the drum cleaner 9Y, a cleaning blade formed for example of polyurethane material is abutted against the surface of the photosensitive drum 4Y, and the cleaning blade is used to collect transfer residual toner remaining on the photosensitive drum 4Y after passing the primary transfer portion T1.

The intermediate transfer belt 2 serving as an image bearing member is an intermediate transfer body that is rotatable while abutting against the photosensitive drums 4Y to 4K. The intermediate transfer belt 2 is stretched around and supported by a tension roller 31, a drive roller 32 and a secondary transfer inner roller 33 and driven by the drive roller 32 to rotate. The intermediate transfer belt 2 moves to the same direction, i.e., direction of arrow R2 in the drawing, as the direction of rotation of the photosensitive drums 4Y to 4K, i.e., direction of arrow R1 in the drawing, at a position abutted against the photosensitive drums 4Y to 4K.

The four-color toner images transferred to the intermediate transfer belt serving as an intermediate transfer body by the image forming units 3Y to 3K are conveyed to a secondary transfer portion T2, which is a transfer nip portion, and collectively secondarily transferred to a recording material P, which is a sheet material such as paper and OHP sheet. The recording material P is taken out of a recording material cassette 101 by a pickup roller 102, separated one sheet at a time and sent to a conveyance path. The recording material P on the conveyance path is transferred to the secondary transfer portion T2 at a matched timing with the toner image on the intermediate transfer belt 2. Then, the recording material P to which toner images of four colors are secondarily transferred is conveyed to a fixing unit 40, where the toner image on the recording material is heated and fixed. The recording material P to which the toner image has been fixed is discharged to the exterior of the apparatus.

The secondary transfer portion T2 serving as the transfer nip portion is formed by pressing the secondary transfer outer roller 34 toward the secondary transfer inner roller 33 with the intermediate transfer belt 2 intervened. The secondary transfer outer roller 34 serving as a transfer member is a roller in which an elastic layer formed of ion-conductive foamed rubber (such as material having surfactant and the like injected to rubber such as NBR, EPDM and urethane, or ion-conductive high polymer formed as a rubber layer) is formed on a metal shaft. A secondary transfer power supply 50 having variable supply voltage is connected to the secondary transfer outer roller 34. In the case of the present embodiment, a transfer electric field is generated in the secondary transfer portion T2 by applying a secondary transfer voltage having positive polarity that is of opposite polarity as toner to the secondary transfer outer roller 34 by the secondary transfer power supply 50 while connecting the secondary transfer inner roller 33 to ground potential (0 V). In response to the transfer electric field, the secondary transfer outer roller 34 collectively secondarily transfers the four-color toner images of yellow, magenta, cyan and black charged to negative polarity having been transferred to the intermediate transfer belt 2 onto the recording material P conveyed to the secondary transfer portion T2.

Control Unit

The image forming apparatus 1 according to the present embodiment includes a control unit 200 (a Central Processing Unit (CPU) 201). The control unit 200 will be described with reference to FIG. 2. Other than the illustrated components, various components such as a motor and a power supply for operating the image forming apparatus 1 may be connected to the control unit 200, but such components are not related with the main idea of the present invention, so that they are not shown in the drawing and descriptions thereof are omitted.

The control unit 200 performs various controls, such as the image forming operation, of the image forming apparatus 1, and includes the CPU 201 and a memory 202 such as a ROM, a RAM or a hard disk device. The memory 202 stores various programs such as an image forming job, and various data for execution such as a reference voltage, a sheet borne voltage or a secondary transfer voltage described later and a plurality of current values supplied during pre-rotation ATVC described later. The CPU 201 is capable of executing various programs stored in the memory 202 and executing various programs to operate the image forming apparatus 1. The memory 202 can temporarily store results of operation processing that accompany the execution of various programs.

An image forming job is a sequence of operations from the start of image forming operation to the completion of the image forming operation based on a printing signal for forming an image on the recording material P. Actually, it refers to a sequence of operations from pre-rotation, i.e., preparation operation before image forming, after a printing signal has been received, i.e., job has been entered, to post-rotation, i.e., operation after image forming, and the execution period of the image forming job includes the image forming period and interval between sheets. In the present specification, interval between sheets, that is, a state where no sheets are conveyed in the secondary nip portion, refers to a predetermined period of time during which an area corresponding to an interval between one recording material P and another recording material P during the image forming job passes the secondary transfer portion T2 (refer to FIG. 1).

The control unit 200 includes, in addition to the CPU 201 and the memory 202, a microcomputer 300, a constant voltage control circuit 301, a constant current control circuit 302, a voltage detection circuit 303, a current detection circuit 304 and a voltage generation circuit 305. The microcomputer 300, the constant voltage control circuit 301, the constant current control circuit 302, the voltage detection circuit 303, the current detection circuit 304 and the voltage generation circuit 305 are arranged on a substrate (not shown) and control the secondary transfer power supply 50 (refer to FIG. 1). The microcomputer 300 serving as a converter is connected to the CPU 201 (general-purpose CPU) serving as a controller through a serial communication interface and the like so that various signals can be sent and received. Under the control of the CPU 201, the microcomputer 300 can send a constant voltage setting signal to the constant voltage control circuit 301, a constant current setting signal to the constant current control circuit 302 and a transfer clock signal to the voltage generation circuit 305. Meanwhile, the microcomputer 300 can acquire a voltage detection signal from the voltage detection circuit 303 and a current detection signal from the current detection circuit 304.

The constant voltage control circuit 301 and the constant current control circuit 302 are operated based on the constant voltage setting signal and the constant current setting signal transmitted from the microcomputer 300. In correspondence therewith, the voltage generation circuit 305 generates a voltage, i.e., output signal, to be applied to the secondary transfer outer roller 34 (refer to FIG. 1). Thereby, voltage is applied by the secondary transfer power supply 50 to the secondary transfer outer roller 34. The voltage detection circuit 303 serving as the voltage detection unit detects voltage from the voltage generation circuit 305, and outputs the voltage being detected as analog voltage detection signal (Vsns) to the constant voltage control circuit 301 and the microcomputer 300. The current detection circuit 304 serving as the current detection unit detects current from the voltage generation circuit 305, and outputs the detected current as analog current detection signal to the constant current control circuit 302 and the microcomputer 300.

The operation of the CPU 201 will be described in further detail. The constant voltage control circuit 301 includes an operational amplifier (IC301) and a diode (D301). The constant current control circuit 302 includes an operational amplifier (IC302) and a diode (D302). The voltage detection circuit 303 includes resistors (R303, R304). The current detection circuit 304 includes an operational amplifier (IC303) and a resistor (R305). The voltage generation circuit 305 includes resistors (R301, R302), a transistor (Q301), a transformer (T301) and an FET (Q302).

The voltage generation circuit 305 adjusts the primary-side voltage of the transformer (T301) by the transistor (Q301) based on the constant voltage setting signal or the constant current setting signal and drives the primary side of the transformer (T301) according to the transfer clock signal to generate voltage, i.e., output signal. The voltage detection circuit 303 detects the voltage applied to the secondary transfer outer roller 34 by dividing the voltage generated by the voltage generation circuit 305 by the resistors (R303, R304), and outputs the same to the constant voltage control circuit 301 and the microcomputer 300 (voltage detection signal). The constant voltage control circuit 301 performs feedback control so that the voltages of the constant voltage setting signal and the voltage detection signal correspond. That is, if the voltage detection signal is greater than the constant voltage setting signal, output is controlled by the operational amplifier (IC301) so that the voltage output by the voltage generation circuit 305 is reduced. Meanwhile, if the voltage detection signal is smaller than the constant voltage setting signal, output is controlled by the operational amplifier (IC301) so that the voltage output by the voltage generation circuit 305 is increased.

The current detection circuit 304 detects the current supplied to the secondary transfer outer roller 34 based on the voltage generated by the voltage generation circuit 305 (current detection signal). The current (Ib) supplied to the secondary transfer outer roller 34 can be represented by Expression 1 shown below using the current detection signal (Isns) detected by the current detection circuit 304. The "Vref" in Expression 1 is a predetermined voltage applied to a non-inverted input terminal (+) side of the operational amplifier (IC303) in the current detection circuit 304.

$$Isns = Ib \times \text{resistance value of resistor } (R305) + Vref \qquad \text{Expression 1}$$

The constant current control circuit 302 can perform feedback control so that the currents of the constant current setting signal and the current detection signal correspond. That is, if the current detection signal is greater than the constant current setting signal, output is controlled by the operational amplifier (IC302) so that the voltage output by the voltage generation circuit 305 is reduced. Meanwhile, if the current detection signal is smaller than the constant current setting signal, output is controlled by the operational amplifier (IC302) so that the voltage output by the voltage generation circuit 305 is increased. Thus, the voltage applied to the secondary transfer outer roller 34 is adjusted.

The diode (D301) of the constant voltage control circuit 301 and the diode (D302) of the constant current control circuit 302 compare the output of the constant voltage control circuit 301 and the output of the constant current control circuit 302. A signal that increases the voltage output by the voltage generation circuit 305 is entered to the base of the transistor (Q301) of the voltage generation circuit 305. During constant voltage control, operation is performed so that the output of the operational amplifier (IC301) is greater than the output of the operational amplifier (IC302), and so that the output of the operational amplifier (IC302) is stuck to ground (GND) level by comparison of the constant current setting signal and the current detection signal. Meanwhile, during constant current control, operation is performed so that output of the operational amplifier (IC302) is greater than the output of the operational amplifier (IC301), and so that the output of the operational amplifier (IC301) is stuck to ground level by comparison of the constant voltage setting signal and the voltage detection signal.

As described, the microcomputer 300 receives detection signals from the voltage detection circuit 303 and the current detection circuit 304, and the microcomputer 300 subjects the voltage detection signal received from the voltage detection circuit 303 and the current detection signal received from the current detection circuit 304 to A/D conversion by an A/D converter (not shown) and samples the same. The microcomputer 300 can perform A/D conversion of signals at a higher speed than the CPU 201, so that the voltage detection signal and the current detection signal can be sampled at a higher speed than the microcomputer 300. That is, the microcomputer 300 and the CPU 201 are configured to convert analog signals to digital signals, and the A/D conversion rate of the microcomputer 300 is faster than the A/D conversion rate of the CPU 201. The A/D conversion rate of the microcomputer 300 is, for example, 1 MHz. In the present embodiment, the voltage detection signal and the current detection signal are respectively subjected to A/D conversion at two channels, so that the sampling period of reading the voltage detection signal and current detection signal can be set to 500 kHz (1 MHz/2) per channel. The microcomputer 300 subjects the voltage detection signal and the current detection signal having been subjected to A/D conversion to serial conversion and outputs the same to the CPU 201. Conventionally, the microcomputer 300 was not provided, so that the CPU 201 directly acquired the voltage detection signal and the current detection signal from the voltage detection circuit 303 and the current detection circuit 304.

Next, a method for setting the secondary transfer voltage will be described. In order to transfer the toner image on the intermediate transfer belt 2, i.e., on the image bearing member, to the recording material P during the image forming job, the CPU 201 performs constant voltage control to apply a constant secondary transfer voltage to the secondary transfer outer roller 34 regardless of the amount of toner related to image formation. However, there is a need to apply the secondary transfer voltage so that a target current for transferring the toner image is supplied to the secondary transfer portion T2. If the current supplied to the secondary transfer portion T2 is smaller than the target current, transfer defects may be caused where the toner image is not sufficiently transferred from the intermediate transfer belt 2 to the recording material P, while if the current supplied to the secondary transfer portion T2 is greater than the target current, abnormal discharge may occur at the secondary transfer portion T2. In order to avoid these problems, it is necessary to supply current that does not cause transfer defects and abnormal discharge in the secondary transfer portion T2 as target current to the secondary transfer portion T2.

Therefore, the CPU 201 executes pre-rotation ATVC during pre-rotation of the image forming job. Pre-rotation ATVC is a control that sets a voltage configured to supply target current to the secondary transfer portion T2 when the recording material P is not passed through the secondary transfer portion T2 as reference voltage, and it is performed by constant current control. Since reference voltage configured to supply target current varies according to the fluctuation of environment, such as temperature and humidity, and the change in the electric resistance of the secondary transfer outer roller 34 by long-term use, so that the CPU 201 performs pre-rotation ATVC during pre-rotation. According to the present embodiment, similar to the prior art, pre-rotation ATVC is performed at a start of an image forming job after a total number of recording materials P to which image has been formed exceeds a predetermined number of sheets, such as 1000 sheets.

Pre-Rotation ATVC

Figure 2:
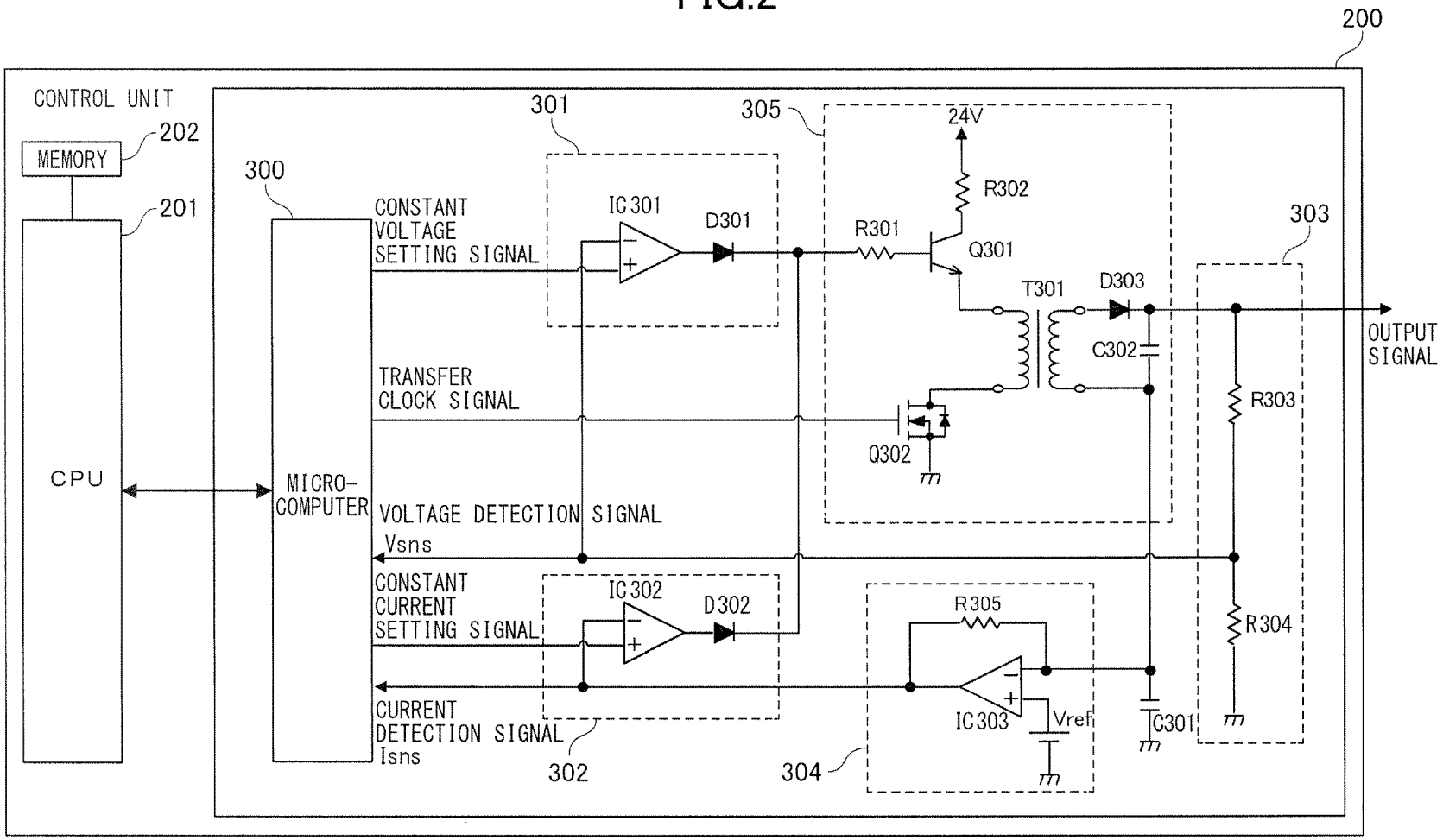
FIG. 2 is a schematic drawing illustrating a control unit.
Figure 6:
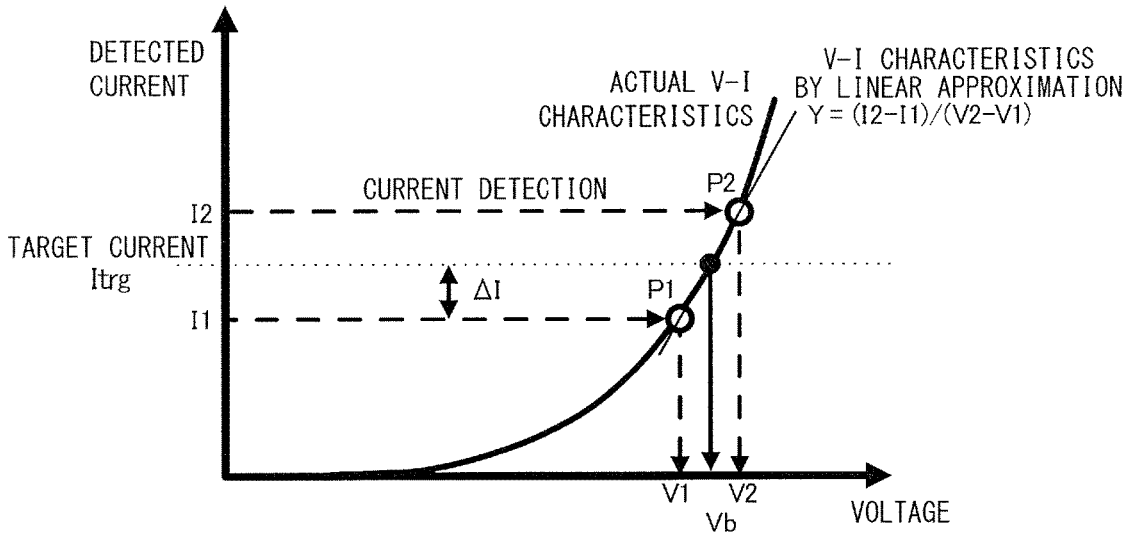
FIG. 6 is a view illustrating a pre-rotation ATVC.

Pre-rotation ATVC will be described briefly based on FIG. 6 with reference to FIGS. 1 and 2. Pre-rotation ATVC refers to a process of computing a reference voltage (Vb1) for supplying an appropriate target current (Itrg) to the secondary transfer portion T2 during interval between sheets. The pre-rotation ATVC is executed during pre-rotation preceding image formation, and pre-rotation ATVC is performed by constant current control. In further detail, in order to supply a plurality of currents (I1 and I2 of FIG. 6) stored in the memory 202 in advance sequentially to the secondary transfer outer roller 34, the CPU 201 applies test voltages (V1 and V2 of FIG. 6) corresponding to respective currents sequentially. One of the currents (I1) is a current smaller than the target current and the other current (I2) is a current greater than the target current. The CPU 201 performs linear approximation using points P1 (I1, V1) and P2 (I2, V2) in FIG. 3 corresponding to the respective currents (Y=(I2−I1)/(V2−V1)), assumes the acquired result as voltage-current characteristics (V-I characteristics) of the secondary transfer outer roller 34, and stores the same in the memory 202. Then, according to the above-described voltage-current characteristics (Y), the CPU 201 computes a reference voltage (Vb=V1+ΔI/Y) based on a difference (ΔI) between the target current and a current (I1) smaller than the target current and the voltage (V1) applied when the current (I1) was supplied and stores the same in the memory 202.

As described, the reference voltage (Vb) computed by pre-rotation ATVC is a voltage configured to supply target current to the secondary transfer portion T2 when no recording material P is passed through the secondary transfer portion T2. Meanwhile, the secondary transfer voltage applied to the secondary transfer outer roller 34 during the image forming job may cause transfer defects if the voltage is not configured to supply target current to the secondary transfer portion T2 while the recording material P is passed through the secondary transfer portion T2. Therefore, in order to set the secondary transfer voltage, it is necessary to consider the electric resistance of the recording material P passing through the secondary transfer portion T2 in addition to the electric resistance of the secondary transfer outer roller 34. Therefore, the CPU 201 sets the secondary transfer voltage to be applied to the secondary transfer outer roller 34 during the image forming job based on a sum of the above-described reference voltage (Vb) and a sheet borne voltage (Vp) considering the electric resistance of the recording material P. That is, the reference voltage will serve as the reference when setting the secondary transfer voltage. Different voltage values, i.e., predetermined voltages, that differ according to the temperature and humidity acquired by an environment sensor (not shown) provided in the apparatus body, the type of recording material P and whether the side of the sheet is a front side or a rear side, are assigned in advance as sheet borne voltage (Vp), and stored in advance in the memory 202.

However, if images are continuously formed to a large number of recording materials P, the electric resistance of the secondary transfer outer roller 34 may be varied, as described earlier. If the secondary transfer voltage based on the reference voltage (Vb) set by the above-described pre-rotation ATVC is continued to be applied regardless of such state, target current may not flow to the secondary transfer portion T2 and image defects may be caused. Therefore, the CPU 201 executes ATVC at interval between sheets each time image is formed continuously to a predetermined number of, such as 100, recording materials P to thereby correct the reference voltage. In a general ATVC at interval between sheets, the reference voltage is corrected to a voltage configured to supply a target current to the secondary transfer portion T2 during interval between sheets based on a current value detected by performing constant voltage control and the voltage-current characteristics of the secondary transfer outer roller 34 acquired by the pre-rotation ATVC.

ATVC at Interval Between Sheets According to Prior Art

Figure 7:
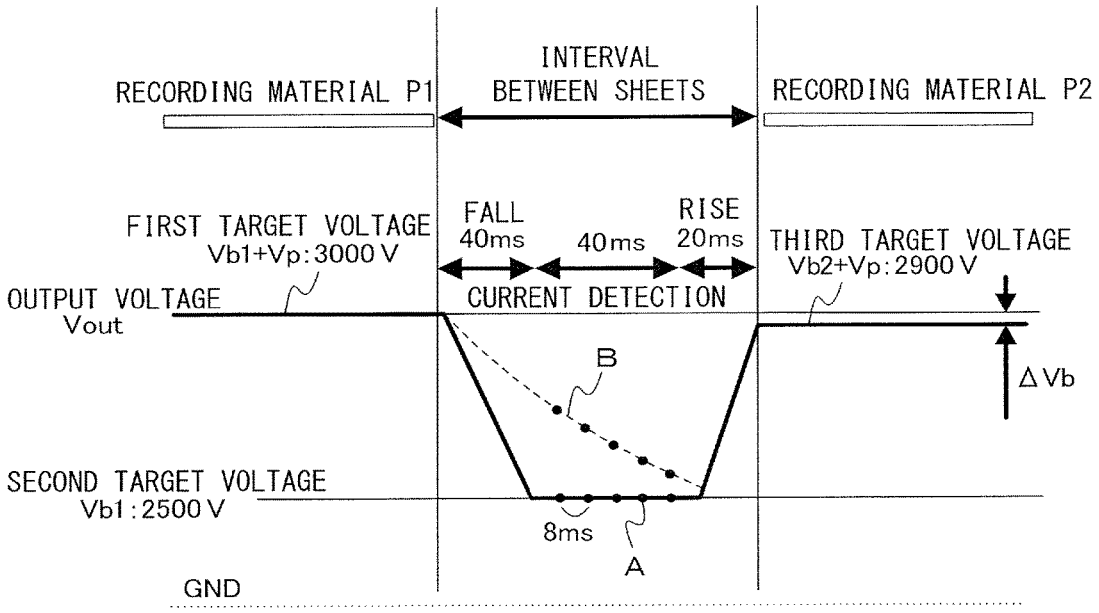
FIG. 7 is a timing chart illustrating a current detection of ATVC at interval between sheets according to the prior art.

Now, the ATVC at interval between sheets according to the prior art will be described with reference to FIGS. 7 and 8. Now, the reference voltage (Vb1) set by the pre-rotation ATVC is set to 2500 V, the reference voltage (Vb2) corrected by the ATVC at interval between sheets is set to 2400 V, and the sheet borne voltage (Vp) of the recording material P is set to 500 V. Further, the interval between sheets is set to 100 ms, the time required for the voltage to fall by the switching of voltage applied to the secondary transfer outer roller 34 is set to 40 ms, and the time required for the voltage to rise accompanying the switching of voltage is set to 20 ms. In this case, the time assigned for current detection during application of reference voltage is 40 (100−40−20) ms. In FIG. 7, the black dots represent current detection timings by the CPU 201 (refer to FIG. 2).

Considering that the voltage-current characteristics of the secondary transfer outer roller 34 is actually nonlinear, in order to compute the reference voltage (Vb1) with high accuracy, it is preferable to detect the current in a state where voltage configured to supply equivalent current during interval between sheets as during image transfer, that is, voltage as close to the reference voltage (Vb1) as possible, is applied. The CPU 201 (refer to FIG. 2) executes ATVC at interval between sheets after completing transfer of image to the recording material P1 by secondary transfer voltage. In the example illustrated in FIG. 7, the secondary transfer voltage of the recording material P1 immediately prior to executing ATVC at interval between sheets is set to a first target voltage (3000 V), which is the sum of reference voltage (Vb1: 2500 V) and sheet borne voltage (Vp: 500 V).

The CPU 201 switches the voltage applied to the secondary transfer outer roller 34 from the first target voltage (3000 V) to a reference voltage (Vb1: second target voltage (2500 V)) already set according to pre-rotation ATVC. After the second target voltage has been reached, that is, at least after elapse of time required for the voltage to fall, the CPU 201 detects the current values five times at 8-ms intervals (refer to solid line A in the drawing) and performs averaging processing of the detected current values. As the averaging processing, for example, among the five current values detected, the three current values having removed the maximum and minimum current values are averaged.

Figure 8:
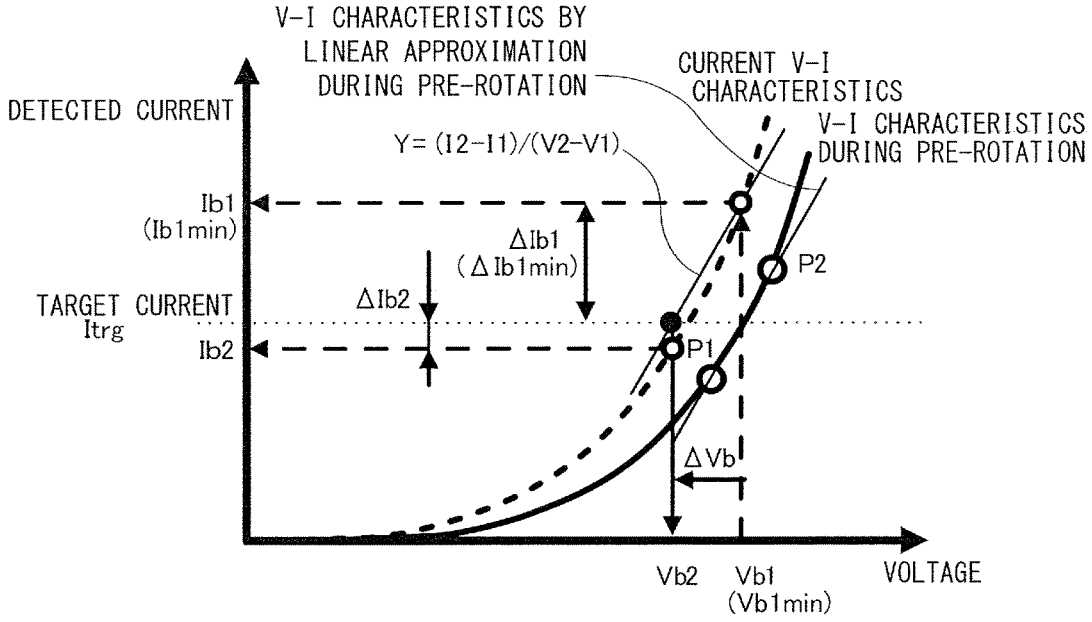
FIG. 8 is a view illustrating correction of reference voltage.

As illustrated in FIG. 8, the CPU 201 computes a difference between the averaged current value (Ib1) and the target current (Itrg). Based on the computed current difference (ΔIb1) and voltage-current characteristics (Y) acquired by pre-rotation ATVC, a reference voltage correction amount (ΔVb=ΔIb1/Y) is acquired. The reference voltage correction amount (ΔVb: −100 V, for example) is added to the second target voltage (Vb1) (Vb2=Vb1+ΔVb) to acquire the reference voltage after correction (Vb2). Then, in order to form an image on the next recording material P2 passing the secondary transfer portion T2, a third target voltage (2900 V), which is a sum of the corrected reference voltage (2400 V) and the sheet borne voltage (500 V), is set as the secondary transfer voltage to be applied during image forming (refer to FIG. 7). According to this configuration, the current flowing to the secondary transfer outer roller 34 is the current shown by "Ib2" in FIG. 8, and the error from the target current is "ΔIb2". That is, by correcting the reference voltage, the error between the current supplied to the secondary transfer outer roller 34 and the target current can be reduced from the "ΔIb1" before correction to "ΔIb2" after correction.

Figure 9:
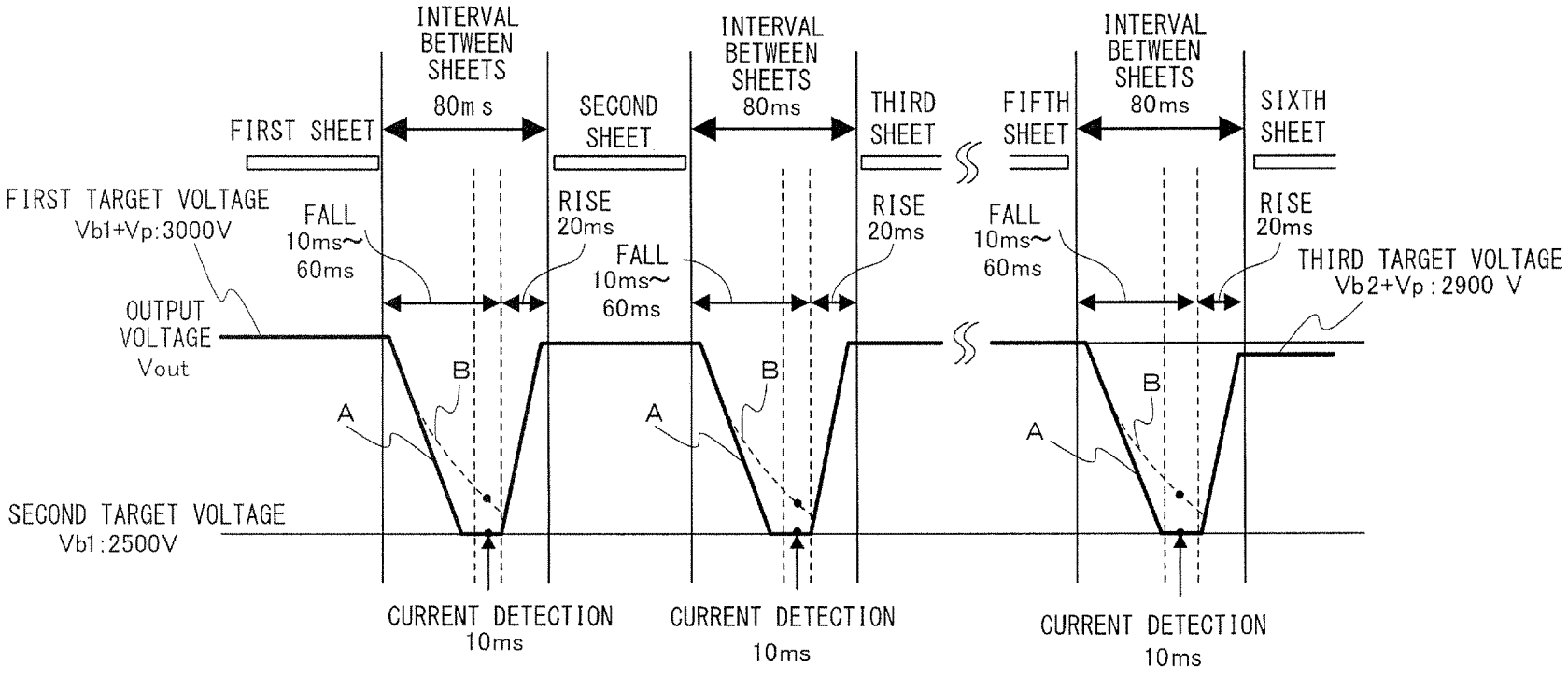
FIG. 9 is a timing chart illustrating a current detection of ATVC at interval between sheets according to the prior art in a state where interval between sheets is short.

Recently, in order to further improve the productivity of the image forming apparatus, the processing speed of the image forming process is increased and the interval between sheets is shortened as much as possible. If the interval between sheets is shortened (to 80 ms, for example), the time assigned for current detection while applying reference voltage is reduced (20 ms) since the time required for the voltage to fall (40 ms) and the time required for the voltage to rise (20 ms) are not changed. FIG. 9 illustrates current detection timings of ATVC at interval between sheets according to the prior art in a state where the interval between sheets is shortened (black dots in FIG. 9). In this example, current is detected at 10-ms intervals, so that one current is detected during one interval between sheets.

As illustrated in FIG. 9, if the interval between sheets is shortened, current can only be detected once, or at most twice, during one interval between sheets in a state where the second target voltage (Vb1) is applied. Therefore, it is difficult to perform averaging processing of the current values and acquire a current value suitable for correcting the reference voltage (Ib1: refer to FIG. 8). Therefore, as illustrated by the solid line A of FIG. 9, the current value to be used for correction of reference voltage is acquired by averaging a plurality of current values acquired by performing ATVC at interval between sheets continuously at multiple (such as five) intervals between sheets. In the example illustrated in FIG. 9, the secondary transfer voltage is set to the third target voltage (2900 V) from the sixth sheet from the first recording material after the reference voltage has been corrected.

However, the time required for the voltage to fall accompanying the switching of voltage from the secondary transfer voltage to the second target voltage may actually vary according to the change in electric resistance of the secondary transfer outer roller 34. In that case, there was a case where the detection of current was performed before the voltage had reached the second target voltage (Vb1), as illustrated by the dotted lines of FIG. 9. Further, if the interval between sheets were shortened in the prior art, even if a plurality of currents could be detected during one interval between sheets, there was a case where the voltage has not reached the second target voltage, as illustrated by dotted lines in FIG. 7. That is, during interval between sheets, it was necessary to secure the time required for the voltage to rise accompanying the switching of voltage from the second target voltage to the secondary transfer voltage, and if the interval between sheets is shortened, there would not be enough time to start current detection after waiting for the actual voltage to reach the second target voltage. In such case, the current was detected before reaching the second target voltage. According to the prior art, if the reference voltage is corrected based on a current detected before reaching the second target voltage, the reference voltage could not be corrected appropriately. The reason for this inconvenience is that according to the prior art, the reference voltage is corrected by actually measuring only the current without measuring the voltage since it is assumed that the voltage has reached the reference voltage. Therefore, even if the secondary transfer voltage is applied based on the corrected reference voltage, transfer defects and abnormal discharge may be caused, and image defects such as image voids may occur.

ATVC at Interval Between Sheets According to Present Embodiment

Figure 3:
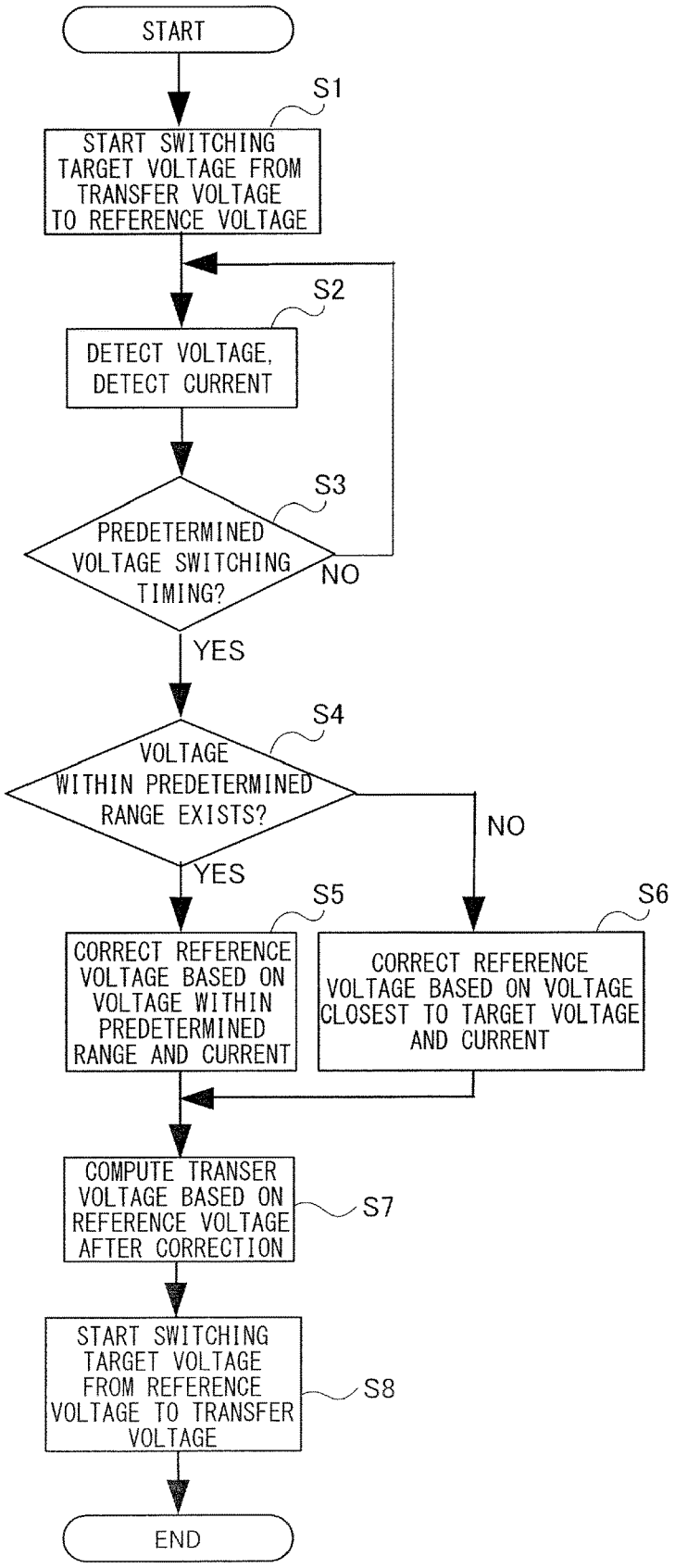
FIG. 3 is a flowchart illustrating ATVC at interval between sheets according to the present embodiment.

In consideration of the issues described above, the present embodiment performs ATVC at interval between sheets such that the reference voltage is corrected appropriately according to the current detected during falling of the voltage, even if only current during falling of voltage accompanying the switching of voltage from the secondary transfer voltage to the second target voltage (Vb1) is detected. In order to do so, in addition to actually measuring the current supplied to the secondary transfer outer roller 34, the present embodiment actually measures the voltage applied to the secondary transfer outer roller 34. FIG. 3 illustrates a flowchart of the ATVC at interval between sheets of the present embodiment enabling to correct reference voltage based on the voltage and current that have been actually measured. The ATVC at interval between sheets of the present embodiment is a control, i.e., program mode, executed by the CPU 201 (refer to FIG. 2) at interval between sheets each time the number of the recording materials P to which image has been formed continuously exceeds a predetermined value, such as 100, as information regarding the image forming time during the image forming job.

As illustrated in FIG. 3, in a state where ATVC at interval between sheets is started, i.e., during program mode, the CPU 201 starts to switch the voltage applied to the secondary transfer outer roller 34 from the secondary transfer voltage, i.e., first target voltage, applied during passing of the previous recording material P to the reference voltage, i.e., second target voltage (S1). In this step, voltage is switched to the reference voltage stored in the memory 202 (refer to FIG. 2). The reference voltage is a voltage that has lower absolute value than the secondary transfer voltage. Then, the CPU 201 detects voltage and current at predetermined intervals in response to switching of voltage (S2). This voltage detection and current detection are performed from when the voltage is started to be switched to the reference voltage to a predetermined time, that is, after the voltage is switched to the reference voltage and before a predetermined voltage switching timing when switching of voltage to the secondary transfer voltage applied to the next recording material P2 is performed (S3: NO). That is, according to the present embodiment, detection of voltage and current using the voltage detection circuit 303 and the current detection circuit 304 by the CPU 201 is set to be started after the command value of voltage applied to the secondary transfer outer roller 34 is switched to a value corresponding to the reference voltage and before the elapse of time required for the first target voltage to fall to the reference voltage. Further, if the time required for the voltage to fall by the switching of voltage has been changed (for example, dotted line B of FIG. 9), the predetermined time will be shorter than the time required for the voltage to fall from the secondary transfer voltage, i.e., first target voltage, to the reference voltage, i.e., second target voltage. That is, according to the present embodiment, the predetermined time is set to a shorter time than the maximum time required for the voltage to fall from the secondary transfer voltage, i.e., first target voltage, to the reference voltage, i.e., second target voltage. The voltage switching timing is determined in advance based on the length of the interval between sheets and the time required for the voltage to rise when being switched from the reference voltage to the secondary transfer voltage, and it is stored in the memory 202. For example, if the interval between sheets is 65 ms and the time required for the voltage to rise is 15 ms, the voltage switching timing is 50 ms. For example, if the interval between sheets is 100 ms and the time required for the voltage to rise is 20 ms, the voltage switching timing is 80 ms. Further, the time required for the voltage to fall from the secondary transfer voltage to the reference voltage is varied according to the environment such as temperature and humidity in which the image forming apparatus is used and the deterioration of the transfer roller, and the maximum time required for the voltage to fall from the secondary transfer voltage to the reference voltage is the time required for the voltage to fall from the secondary transfer voltage to the reference voltage in a most severe condition from the viewpoint of use environment and service life of the image forming apparatus assumed by the manufacturer. In the following description, the former recording material P may also be referred to as the first recording material, and the latter recording material conveyed continuously after the former recording material may also be referred to as the second recording material.

The CPU 201 determines whether there is a voltage that falls within a predetermined range, such as 2500±20 V, set based on the second target voltage as reference among the voltages, i.e., voltage detection signals Vsns, detected until the predetermined voltage switching timing, i.e., during a predetermined time (S4). In other words, the CPU 201 determines whether there is a voltage that falls within a predetermined range among the plurality of voltages sampled after the command value of the voltage applied to the secondary transfer outer roller 34 has been switched to the value corresponding to the reference voltage and before the voltage is switched to a value corresponding to the transfer voltage for transferring the image to the second recording material. If there is a voltage that falls within the predetermined range (S4: YES), the CPU 201 assumes that the voltage has reached the reference voltage and corrects the reference voltage using the voltage within the predetermined range and the current detected in correspondence therewith, as described in detail later (S5).

Meanwhile, if there are no voltages that fall within the predetermined range (S4: NO), the CPU 201 assumes that the voltage has not reached the reference voltage and corrects the reference voltage using the voltage closest to the second target voltage and the current detected in correspondence therewith, as described in detail later (S6). Then, the CPU 201 adds the sheet borne voltage to the reference voltage after correction to obtain the secondary transfer voltage (S7) and starts to switch the voltage applied to the secondary transfer outer roller 34 from the reference voltage, i.e., second target voltage, to the secondary transfer voltage, i.e., third target voltage (S8). The reference voltage after correction is stored, i.e., updated, in the memory 202. The predetermined range of the voltage is set based on the reference voltage, and the range thereof may be set according to the type of apparatus. The above-described range may also be matched with the reference voltage.

The specific example will be described with reference to FIGS. 4 and 8. Here, an example is illustrated where the reference voltage set by the pre-rotation ATVC (Vb1) is 2500 V, the reference voltage corrected by the ATVC at interval between sheets (Vb2) is 2400 V, and the sheet borne voltage (Vp) of the recording material P is 500 V. That is, the secondary transfer voltage, i.e., first transfer voltage, of the recording material P1 immediately before executing the ATVC at interval between sheets is 3000 V. Further, the interval between sheets is set to 65 ms, transition time required for the voltage to fall accompanying the switching of voltage applied to the secondary transfer outer roller 34 is set to 25 ms or 50 ms, and the transition time required for the voltage to rise accompanying the switching of voltage is set to 15 ms. Therefore, the time assigned to detecting the current when reference voltage is applied is 25 (65−25−15) ms or 0 (65−50−15) ms. The black dots in FIG. 4 represent detection timings of voltage and current.

Figure 4:
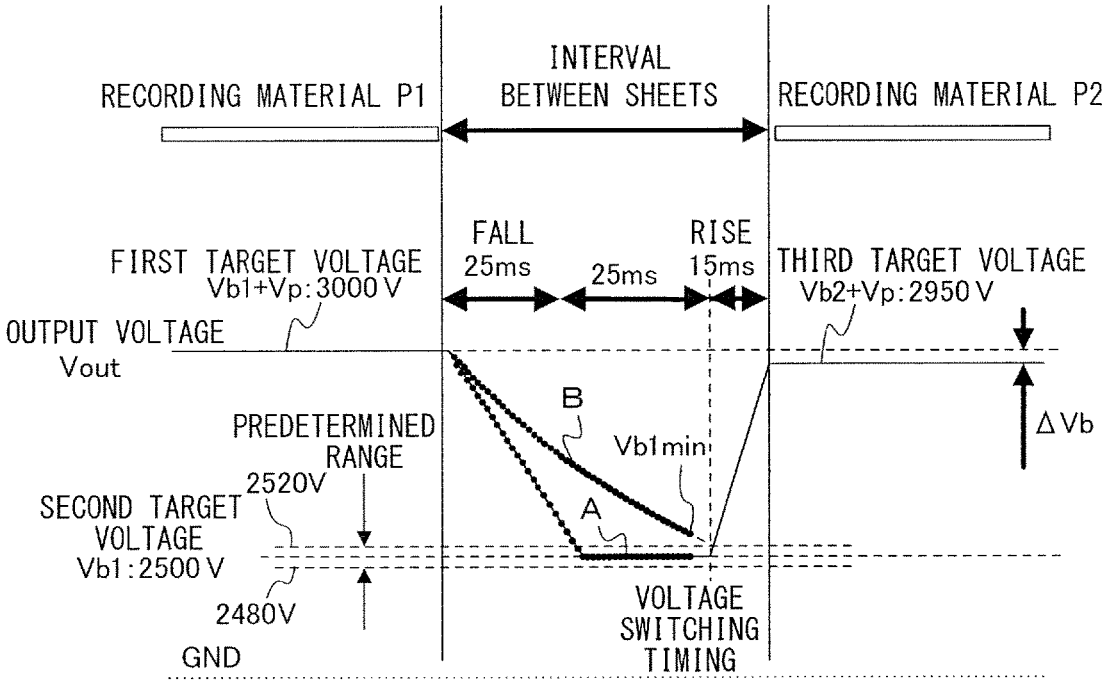
FIG. 4 is a timing chart illustrating current detection of ATVC at interval between sheets according to the present embodiment.

As illustrated in FIG. 4, after completing secondary transfer to the recording material P1, the CPU 201 (refer to FIG. 2) changes the voltage applied to the secondary transfer outer roller 34 from the secondary transfer voltage (3000 V) to the reference voltage that has been set by the pre-rotation ATVC (second target voltage: 2500 V). Then, the voltage and the current are detected regardless of whether the actual voltage has reached the second target voltage. In the present embodiment, by using the microcomputer 300 (refer to FIG. 2), the predetermined interval for detecting the voltage and the current can be shortened, for example, from 8-ms sampling interval to 1-ms sampling interval. That is, the changes of voltage and current during transition of the voltage rising along with the switching of voltage can be sampled in detail.

As shown by the solid line A of FIG. 4, if there is a voltage that falls within the predetermined range, it is assumed that the voltage has reached the second target voltage, and the CPU 201 corrects the reference voltage based on the voltage falling within the predetermined range and the current detected in correspondence with the voltage. At that time, if there are multiple voltages that fall within the predetermined range, the voltages and the currents corresponding thereto are respectively subjected to averaging processing, and based on the averaged voltage and current values, the reference voltage is corrected. If there are no multiple voltages within the predetermined range, there is no need to perform the averaging processing, and the reference voltage should be corrected using the voltage and current values being detected. That is, based on the voltage value (Vb1) and current value (Ib1) acquired by actual measurement, the correction amount of reference voltage (ΔVb: −100 V) is computed as described above (refer to FIG. 8), and the reference voltage is corrected thereby and reset as the reference voltage after correction (Vb2). Then, the secondary transfer voltage applied to the next recording material P2, i.e., second transfer voltage, is set to a third target voltage (2900 V), which is a sum of the reference voltage after correction (2400 V) and the sheet borne voltage (500 V). By correcting the reference voltage by the ATVC at interval between sheets as described, the error between the current supplied to the secondary transfer outer roller 34 and the target current can be reduced from the "ΔIb1" before correction to "ΔIb2" after correction, as illustrated in FIG. 8. In this case, the correction amount of reference voltage may be computed using the second target voltage without using the voltage (Vb1) acquired by actual measurement.

As shown by the dotted line B of FIG. 4, if there are no voltages within the predetermined range, it is assumed that the voltage has not reached the second target voltage, and the CPU 201 corrects the reference voltage based on the voltage closest to the second target voltage among the voltages being detected, or the last detected voltage, and the current detected in correspondence with the voltage. That is, the CPU 201 specifies the voltage closest to the second target voltage among the voltages that do not fall within the predetermined range based on the second target voltage (Vb1min of FIG. 8) and the current corresponding to the voltage (Ib1min). As shown in FIG. 8 in brackets, difference (ΔIb1min) between the specified current value (Ib1min) and the target current (Itrg) is acquired. Next, based on the acquired current difference (ΔIb1min) and the relationship of voltage-current characteristics of the secondary transfer outer roller 34 subjected to linear approximation by pre-rotation ATVC, the correction amount of reference voltage (ΔVb=ΔIb1min/Y) is obtained. In the present embodiment, since the voltage-current characteristics of the secondary transfer outer roller 34 subjected to linear approximation by pre-rotation ATVC is used as it is (refer to FIG. 8), it is preferable to perform correction of reference voltage at a portion where there is only small separation between the voltage-current characteristics subjected to linear approximation. Therefore, as described, the voltage closest to the second target voltage is used among the voltages that do not fall within the predetermined range.

The acquired correction amount of the reference voltage (ΔVb) is added to the voltage closest to the second target voltage (Vb1min) among the voltages being detected (Vb2=Vb1min+ΔVb), by which the reference voltage after correction (Vb2) is obtained. For example, if the voltage close to reference voltage (Vb1min) is 2550 V and the correction amount of reference voltage is −100 V, the reference voltage after correction will be 2450 V. In this case, the secondary transfer voltage applied to the next recording material P2 passing through the secondary transfer portion T2 is set to a third target voltage (2950 V), which is a sum of the corrected reference voltage (2450 V) and the sheet borne voltage (500 V).

As described, according to the present embodiment, in performing ATVC at interval between sheets, in addition to actually measuring the current supplied to the secondary transfer outer roller 34, the voltage applied to the secondary transfer outer roller 34 is actually measured, and the reference voltage is corrected based thereon. By using the actually measured voltage, in performing ATVC at interval between sheets, even if the current could only be detected during fall of voltage accompanying the switching of voltage from the secondary transfer voltage to the reference voltage, the reference voltage may be corrected more appropriately than the prior art. Therefore, secondary transfer voltage that does not cause transfer defects and abnormal discharge can be applied, and therefore, image defects such as image voids are less likely to occur.

That is, according to the present embodiment, the CPU 201 is configured to execute a mode of performing control, during an image forming job of forming an image to a plurality of recording materials including a first recording material and a second recording material that are conveyed continuously, and within a period after a trailing edge of the first recording material has passed the transfer nip portion T2 and before a leading edge of the second recording material enters the transfer nip portion T2, to switch a command value of voltage applied to the transfer member 34 from a value corresponding to a first transfer voltage for transferring an image to the first recording material to a value corresponding to a reference voltage that is lower in absolute value than the first transfer voltage, and after switching the command value, detecting a voltage and a current by the voltage detection unit 303 and the current detection unit 304 before switching the command value of the voltage applied to the transfer member 34 to a value corresponding to the transfer voltage for transferring the image to a second recording material, and based on the voltage and current being detected, correcting the command value of transfer voltage applied to the transfer member 34.

In other words, the CPU 201 is the controller configured to execute a mode for correcting a command value of the transfer bias during a continuous image forming job of forming an image to a plurality of recording materials. The CPU 201 is configured to, in the mode, (i) switch the command value of the voltage applied to the transfer member from a first value corresponding to the transfer voltage applied in a first transfer period for a first recording material to a reference value after the first transfer period before a second transfer period for a second recording material which is following the first recording material, and (ii) switch the command value from the reference value to a second value corresponding to the transfer voltage applied in the second transfer period, in case that a predetermined time has elapsed from switching the command value from the first value to the reference value, and (iii) correct the command value of the transfer voltage on the basis of detection results which are detected by the voltage detection unit and the current detection unit during the predetermined time. Further, the microcomputer 300 may refer to the converter configured to convert analog signals from the voltage detection circuit and the current detection circuit at a first conversion rate to digital signals, and the CPU 201 may refer to a controller whose conversion rate for converting an analog signal to a digital signal is slower than the first conversion rate. The CPU 201 is configured to execute a mode for correcting a command value of the transfer voltage during a continuous image forming job of forming an image to a plurality of recording materials, the controller correcting the command value of the transfer voltage based on digital values which are converted by the converter after a first transfer period for a first recording material before a second transfer period for a second recording material which is following the first recording material.

In the present embodiment, if the voltage being detected is not within the predetermined range (S4: NO), the reference voltage is corrected using the voltage closest to the second target voltage and the current detected in correspondence therewith. In other words, the reference voltage is corrected based on the voltage that satisfies the predetermined condition among the voltages being detected, i.e., voltage closest to the second target voltage, and the current corresponding to the voltage, but the predetermined condition is not restricted thereto. For example, among the plurality of voltages being detected, at least one voltage detected on the side near the second target voltage and the current corresponding to that voltage may be used to correct the reference voltage. In this example, the voltage detected on the side close to the second target voltage refers to a voltage that is closer to the second target voltage than an intermediate value between the voltage farthest from the second target voltage among the voltages being detected (Vb1+Vp) and the voltage closest thereto (Vbmin). Further, if the voltage being detected does not fall within the predetermined range, it may be possible not to perform correction of the reference voltage.

Other Embodiments

In the above-described embodiment, the correction amount of reference voltage was computed using the voltage-current characteristics of the secondary transfer outer roller 34 subjected to linear approximation by pre-rotation ATVC (refer to FIG. 8), but the present embodiment is not restricted to this example. For example, it is possible to compute the correction amount of reference voltage using the current voltage-current characteristics of the secondary transfer outer roller 34 obtained through linear approximation using the voltage and current being detected. This example will be described with reference to FIG. 5.

Figure 5:
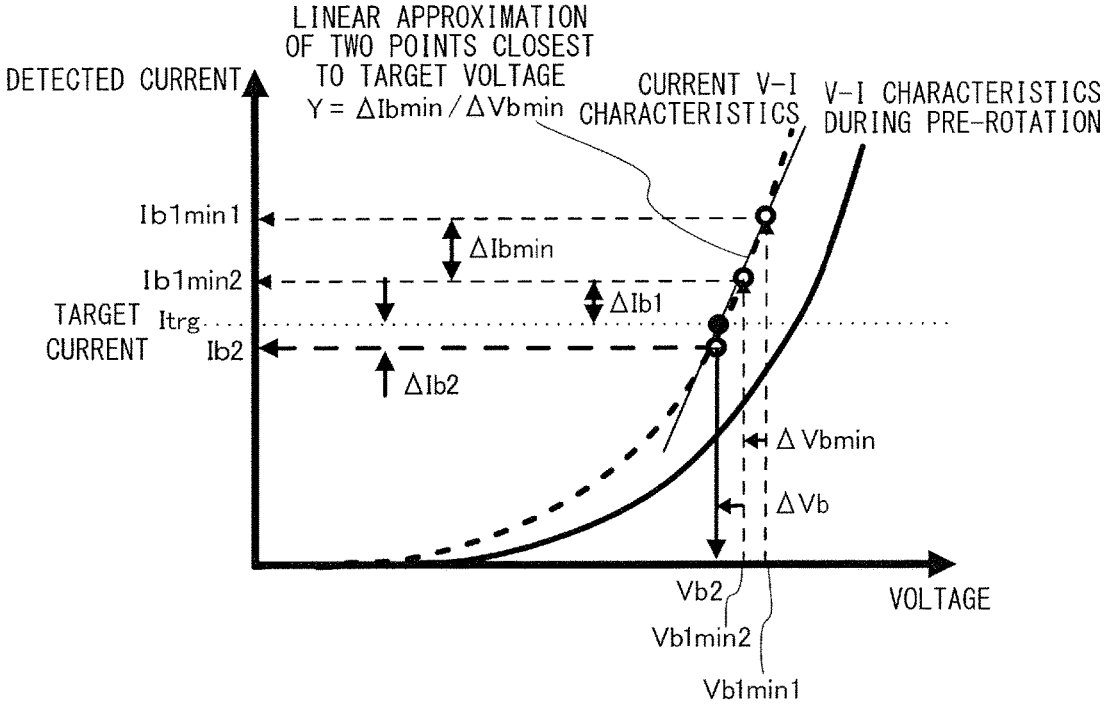
FIG. 5 is a view illustrating voltage-current characteristics.

As illustrated in FIG. 5, linear approximation is performed using the voltage closest to the reference voltage (Vb1min2) and the voltage second closest to the target voltage (Vb1min1), and the current values corresponding thereto (Ib1min2 and Ib1min1) (Y=ΔIbmin/ΔVbmin). This linear approximation is assumed as the current voltage-current characteristics of the secondary transfer outer roller 34. Then, the difference (ΔIb1) between the current value (Ib1min1) and the target current (Itrg) is computed, and the correction amount of reference voltage (ΔVb=ΔIb1/Y) is obtained according to the computed difference (ΔIb1) of the current values and the current voltage-current characteristics subjected to linear approximation. This correction amount of reference voltage (ΔVb) is added to the voltage (Vb1min2) that is closest to the second target voltage among the voltages being detected (Vb2=Vb1min2+ΔVb), thereby obtaining the reference voltage after correction (Vb2). According to this configuration, the current supplied to the secondary transfer outer roller 34 will be the current illustrated as "Ib2" in FIG. 5, and the error from the target current is "ΔIb2". That is, according to this correction of reference voltage, the error between the current supplied to the secondary transfer outer roller 34 and the target current can be reduced from the "ΔIb1" before correction to the "ΔIb2" after correction.

As described, the voltage-current characteristics of the secondary transfer outer roller 34 may be acquired using the voltage and current detected by ATVC at interval between sheets, instead of by pre-rotation ATVC. In such case, reference voltage can be corrected more accurately corresponding to the electric resistance at that time of the secondary transfer outer roller 34. Meanwhile, if voltage-current characteristics obtained by pre-rotation ATVC are used, there is an advantage that the time required to execute the ATVC at interval between sheets is reduced and the interval between sheets can be shortened further.

According to the embodiment described above, the microcomputer 300 (refer to FIG. 2) was used, but the present invention is not restricted thereto, and the microcomputer 300 may not be used. Further according to the embodiment, if there are no multiple voltages and currents detected during one ATVC at interval between sheets, averaging processing is not performed, and the reference voltage is corrected using only that current value, but the present invention is not restricted thereto. If there are no multiple voltages and currents detected during one ATVC at interval between sheets, as described above, it is possible to perform ATVC at interval between sheets for multiple times, such as five times, and subject the multiple voltages and currents acquired thereby to averaging processing. If there are no multiple voltages and currents detected during one ATVC at interval between sheets, such as when the microcomputer 300 was not used, there may be a case where reference voltage is corrected using the voltage closest to the second target voltage and the current detected in correspondence therewith (refer to S6 of FIG. 3).

Figure 10:
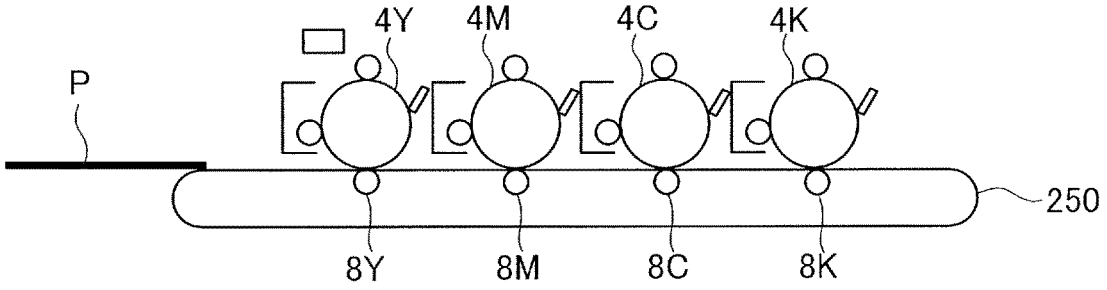
FIG. 10 is a schematic diagram illustrating an image forming apparatus according to a direct transfer system.

In the above-described embodiment, an intermediate transfer-type image forming apparatus was described, but the present invention is not restricted thereto. The above-described embodiment can be applied, for example, to a direct-transfer type image forming apparatus where toner images are directly transferred from a plurality of photosensitive drums 4Y to 4K as image bearing members to the recording material P conveyed to a conveyor belt 250, as illustrated in FIG. 10. Also, although the CPU 201 is configured to correct the secondary transfer voltage for transferring the toner image to the recording material P2 on the basis of the detection results which are detected in the non-transfer period between the transfer period for transferring the toner image to the recording material P1 and the transfer period for transferring the toner image to the recording material P2 in the above-described embodiment, the CPU 201 may correct the secondary transfer voltage for transferring the toner image to a following recording material conveyed after the recording material P2 on the basis of the detection results, without correcting the secondary transfer voltage for transferring the toner image to the recording material P2.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-141251, filed Jul. 20, 2017, which is hereby incorporated by reference herein in its entirety.

What is claimed is:

1. An image forming apparatus comprising:

a rotatable image bearing member configured to bear a toner image;

a transfer member configured to form a transfer nip portion by abutting against the image bearing member, and configured to transfer the toner image on the image bearing member to a recording material by being applied a transfer voltage;

a power supply configured to apply a voltage to the transfer member;

a voltage detection unit configured to detect the voltage applied to the transfer member from the power supply;

a current detection unit configured to detect a current supplied to the transfer member; and a controller configured to execute a mode for correcting the transfer voltage during a continuous image forming job of forming an image on a plurality of recording materials including a first recording material and a second recording material which follows the first recording material, the controller, in the mode, (i) changing the voltage applied to the transfer member toward a reference voltage in a non-transferring period in which an area on the image bearing member corresponding to an area between the first recording material and the second recording material passes through a transfer portion, and (ii) correcting the transfer voltage on the basis of detection results which are detected during a predetermined time in the non-transferring period by the voltage detection unit and the current detection unit, wherein the predetermined time is set to a time shorter than a maximum time required for the transfer voltage to fall to the reference voltage.

2. The image forming apparatus according to claim 1, wherein in case that the voltage detected by the voltage detection unit does not reach a predetermined range until the predetermined time has elapsed, the controller sets the transfer voltage based on a voltage closest to the reference voltage, among voltages being detected in the predetermined time.

3. The image forming apparatus according to claim 1, wherein in case that the voltage detected by the voltage detection unit during the predetermined time falls within a predetermined range, the controller corrects the transfer voltage based on the voltage that has fallen within the predetermined range among voltages being detected in the predetermined time.

4. The image forming apparatus according to claim 1, wherein the controller corrects the transfer voltage based on voltage-current characteristics acquired during pre-rotation of the image forming job.

5. The image forming apparatus according to claim 1, wherein the controller corrects the transfer voltage based on voltage-current characteristics acquired during the predetermined time.

6. The image forming apparatus according to claim 1, wherein the controller executes the mode each time when information regarding an image forming time exceeds a predetermined value during the image forming job.

7. The image forming apparatus according to claim 6, wherein the information regarding the image forming time is a number of sheets of recording materials subjected to image forming.

8. The image forming apparatus according to claim 1, wherein the image bearing member is a photosensitive member on which a toner image is developed by developer.

9. The image forming apparatus according to claim 1, wherein the image bearing member is an intermediate transfer body to which a toner image on a photosensitive member developed by developer is transferred.

10. The image forming apparatus according to claim 1, wherein the controller sets the transfer voltage based on a voltage set in advance in correspondence with a type of the recording material and the reference voltage, and the controller corrects the transfer voltage by correcting the reference voltage.

* * * * *